US005747801A

United States Patent [19]

Quarmby et al.

[11] Patent Number: 5,747,801

[45] Date of Patent: May 5, 1998

[54] METHOD AND DEVICE FOR IMPROVED TRAPPING EFFICIENCY OF INJECTED IONS FOR QUADRUPOLE ION TRAPS

[75] Inventors: Scott T. Quarmby; Richard A. Yost, both of Gainesville, Fla.

[73] Assignee: University of Florida, Gainesville, Fla.

[21] Appl. No.: 788,155

[22] Filed: Jan. 24, 1997

[51] Int. Cl.[6] ..... H01J 49/42

[52] U.S. Cl. ..... 250/292; 250/281; 250/282

[58] Field of Search ..... 250/292, 293, 250/291, 290, 281, 282

[56] References Cited

U.S. PATENT DOCUMENTS 5,679,950 10/1997 Baba et al. ..... 250/292

OTHER PUBLICATIONS

Ghosh, P.K., Arvind S. Arora and Lakshmi Narayan (1977) "Ion Path Lenghts In A Three–Dimensional RF Quadrupole Trap" International Journal of Mass Spectrometry and Ion Physics 23:237–240.

Moore, R.B. and S. Gulick (1988) "The Transfer of Continuous Beams and Storage Ring Beams into Electromagnetic Traps" Physica Scripta. vol. T22:28–35.

O, Chun–Sing and Hans A. Schuessler (1981) "Confinement of ions created externally in a radio–frequency ion trap" J. Appl. Phys. 52(3):1157–1166.

Moore, R.B., M.D. N. Lunney and G. Rouleau (1992) "The Manipulation of Ions using Electromagnetic Traps" Physica Scripta 46:569–574.

Moore, R.B. M.D.N. Lunney, G. Rouleau, G. Savard (1992) "Collection, cooling and delivery of ISOL beams" Nuclear Instruments and Methods in Physics Research B70:482–489.

Bollen, G. et al. (1966) "Isoltrap A Tandem Penning Trap System for Accurate Online Mass Determination Of Short–Lived Isotopes" In: Nuclear Instruments & Methods in Physics Research, Section A–Accelerators Spectrometers Detectors And Associated Equipment 368(3):675–697 Abstract only.

Moore, R.B. (1993) The manipulation of charged particles into and out of electromagnetic traps Hyperfine Interactions 81:45–70.

Moore, R.B. And G. Rouleau (1992) "In–flight capture of an ion beam in a Paul trap" Journal of Modern Optics 39(2):361–371.

Moore, R.B. et al. (1995) "Production, Transfer and Injection of Charged Particles in Traps and Storage Rings" Physica Scripta. T59:93–105.

Dezfuli, A.M.G., R.B. Moore, and P. Varfalvy (1996) "A Compact 65 Kev Stable Ion Gun For Radioactive Beam Experiments" In: Nuclear Instruments & methods in Physics Research, Section A–Accelerators Spectrometers Detectors and Associated Equipment 368(3):611–616. Abstract only.

*Primary Examiner*—Kiet T. Nguyen

*Attorney, Agent, or Firm*—Saliwanchik, Lloyd & Saliwanchik

[57] ABSTRACT

The methods and devices which improve the trapping efficiency of injected ions for quadrupole ion traps. The methods and apparatus of the subject invention can be used in quadrupole ion trap mass spectrometry. The technique of the subject can, for example, vary the amplitude of the trap offset voltage with respect to RF phase angle and/or apply a time varying voltage to at least one lens external to the trap, thus altering the potential energy profile near the entrance to the trap and, therefore, altering the kinetic energy and/or arrival time of ions entering the ion trap. By controlling the kinetic energy and/or arrival time, a larger percentage of injected ions arrive at the ion trap with a kinetic energy conducive for trapping given the corresponding arrival RF phase angle. This allows a larger percentage of injected ions to be successfully trapped and therefore improves the sensitivity and analytical utility of the mass spectrometer.

24 Claims, 12 Drawing Sheets

METHOD AND DEVICE FOR IMPROVED TRAPPING EFFICIENCY OF INJECTED IONS FOR QUADRUPOLE ION TRAPS

BACKGROUND OF THE INVENTION

The quadrupole ion trap invented by Paul and Steinwedel (Paul, W. and H. Steinwedel [1960]) is a highly versatile and sensitive mass spectrometer. The fundamentals and operation of the quadrupole ion trap mass spectrometer have been previously described (March, R. E. and R. J. Hughes, Eds. [1989] and March, R. E., J. F. J. Todd, Eds. [1995]). Because of the many advantages offered by the ion trap, there has been a lot of research put into coupling the ion trap with different ionization techniques. Although originally only used with electron ionization and chemical ionization, the ion trap has now been successfully coupled to laser desorption, matrix-assisted laser desorption, secondary ion mass spectrometry, fast atom bombardment, electrospray, thermospray, glow discharge, and inductively coupled plasma. Many of these techniques require ions to be formed externally, transported by, for example, an octopole ion guide, and then injected into the ion trap. For example, current versions of the Finnigan MAT GCQ™ and LCQ™ quadrupole ion trap mass spectrometers form ions externally and then inject and trap them in the ion trap for subsequent mass analysis.

The difficulty of trapping ions formed externally and then injected into the ion trap is that, unless the ions enter the trap at the correct phase angle of the RF drive voltage, they will not have the correct combination of velocity and displacement to remain in stable orbits (March, R. E., J. F. J. Todd, Eds. [1995]). This RF drive voltage can also be referred to as the fundamental RF trapping voltage. Specifically, it is known that the fundamental RF trapping voltage applied, for example, to the ring electrode, has a dramatic effect on the efficiency with which injected ions are trapped. In fact, not only is the amplitude of the fundamental RF trapping voltage important, in addition, the phase angle of the fundamental RF trapping voltage the moment at which ions enter the ion trap is critical with respect to the trapping efficiency. This phase angle of the applied RF voltage at the moment at which an ion enters the trap, i.e., crosses the boundary of the entrance endcap, is referred to as the "arrival RF phase angle" of the injected ion. For injected ions to be trapped, they must have sufficient kinetic energy to climb the potential energy barrier existing near the entrance of the trap and enter the trap, but not so much kinetic energy that they escape the potential well within the trap and travel straight through.

As a result, for a given ion kinetic energy and mass-to-charge ratio (m/z), there is only a very narrow range of arrival RF phase angles which an ion entering the trap can have in order for the ion to be successfully trapped. One technique used to more efficiently trap a packet of ions whose temporal spread is on the order of the width of this efficient range of RF phases, is to time the arrival of the packet such that the packet arrives during an efficient phase window. However, if the ion beam is temporally wider, merely applying a constant RF voltage to the ring electrode will result in losing many of the ions which enter the ion trap. A technique which could increase the range of arrival RF phase angles over which ions are trapped would greatly improve the sensitivity and the analytical utility of the instrument.

Many papers have appeared in the literature on the study of ion injection into quadrupole ion traps and new techniques have been developed for increasing the efficiency with which ions are transported into the ion trap and subsequently trapped (for example, Moore et al. [1988]; Louris et al. [1989]; Moore et al. [1992a]; Moore et al. [1992b]; Moore et al. [1992c]; Moore, R. B. [1993]; Doroshenko et al. [1993]; Eiden et al. [1994]; Wang et al. [1995] and Qin et al. [1996]). In particular, many papers have appeared utilizing computer simulations (for example, Ghosh et al. [1977]; O et al. [1981]; and Weil et al. [1996]). It has been demonstrated with computer simulations that ions of different kinetic energies are trapped at different arrival RF phase angles (for example, O et al. [1981]; and Moore et al. [1988]). Our own computer simulations of, ion injection using SIMION v6.0 support this finding. Many previous techniques can efficiently trap pulsed ion beams with temporal spreads wider than the RF phase window. However, these same techniques can cause currently trapped ions to be lost, preventing multiple pulses of ions from being accumulated. A technique which could facilitate the trapping and accumulation of multiple pulses of injected ions would greatly increase the analytical sensitivity of the instrument.

A particularly challenging ion beam to efficiently trap is one that has a constant stream of ions. An efficient trapping technique must be able to capture a high percentage of ions while not disturbing ions which are already trapped, such that ions can be accumulated over time. A technique which could facilitate the efficient trapping and accumulation of a constant stream of ions would greatly increase the analytical sensitivity of the instrument.

BRIEF SUMMARY OF THE INVENTION

The subject invention pertains to a technique which increases the percentage of ions, having been injected into an ion trap, which are trapped, and is based on the fact that ions injected into the ion trap with different kinetic energies are trapped at different arrival R-F phase angles. The technique of the subject invention can, for example, vary the amplitude of the trap offset voltage with respect to RF phase angle, thus altering the potential energy profile near the entrance to the trap and, therefore, altering the kinetic energy and/or arrival time of ions entering the ion trap. Specifically, through the application of time varying voltages, the kinetic energy and/or arrival time of ions entering the ion trap can be varied as a function of the RF phase angle. By controlling the kinetic energy and/or arrival time, a larger percentage of injected ions arrive at the ion trap with a kinetic energy conducive for trapping given the corresponding arrival RF phase angle and, therefore, the range of arrival RF phase angles over which ions are trapped increases. This allows a larger percentage of injected ions to be successfully trapped and therefore improves the sensitivity and analytical utility of the mass spectrometer. Similar improvements in sensitivity can result from similar methods of varying the kinetic energy and the RF phase angle at which ions enter the ion trap, including, for example, the application of time varying voltages on ion optic elements such as lenses placed outside the entrance endcap.

DETAILED DISCLOSURE OF THE INVENTION

The subject invention pertains to devices and corresponding methods for increasing the percentage of ions, having been injected into an ion trap, which are trapped. In a specific embodiment, the subject invention varies the amplitude and phase offset, from the fundamental RF trapping voltage, of an AC offset voltage which can be any periodic time varying voltage, applied to the ring and endcap electrodes, thus altering the potential energy profile near the entrance to the trap as a function of time. Advantageously, the time varying potential energy profile surrounding the entrance to the ion trap can alter the injection kinetic energy and/or arrival time of the injected ions, whereby the altered injection kinetic energy and/or arrival time of the injected ions increases the efficiency with which the injected ions are trapped in the ion trap. Consequently, the improved trapping efficiency enhances the sensitivity and analytical utility of the mass spectrometer. In a preferred embodiment, a lens can be added near the entrance endcap aperture to minimize, or shield, the effect of the ion trap RF fields on the ions as they approach the ion trap.

In an alternative embodiment, at least one AC offset voltage, which can be any periodic time varying voltage, can be applied to at least one lens, which can be located near the entrance endcap aperture, to vary the potential in and around the entrance endcap aperture. In additional embodiments, combinations of an AC offset voltage applied to the ring and endcap electrodes and at least one AC offset voltage applied to at least one lens located near the entrance endcap aperture, may be applied to vary the potential in and around the entrance endcap aperture. The variation of the potential near the entrance endcap aperture can vary the injection kinetic energy and/or arrival RF phase, thus increasing the efficiency with which the injected ions are trapped in the ion trap.

Figure 1A:
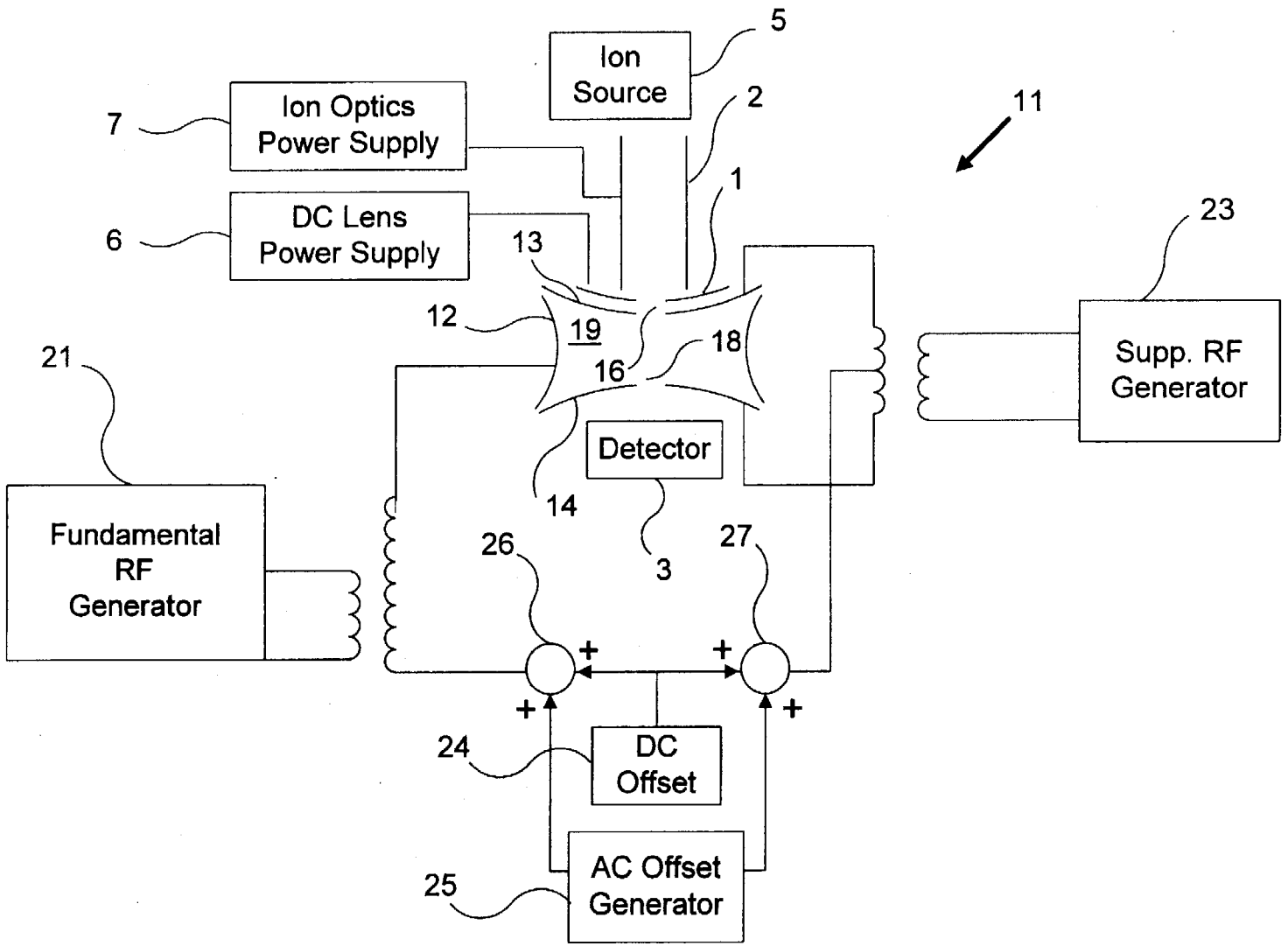
FIG. 1A shows a cross-section of one embodiment of a quadrupole ion trap mass spectrometer where an AC offset time varying voltage is applied to the ring electrode and endcap electrodes in accordance with the subject invention.

Referring to FIG. 1A, a cross-section of a quadrupole ion trap mass spectrometer 11 is shown. The mass spectrometer 11 shown in FIG. 1A includes an ion trap having a ring electrode 12 and endcap electrodes 13 and 14. The entrance endcap 13 includes an aperture 16 through which ions formed external to the ion trap may be injected into the ion trap volume 19 for potential capture. The exit endcap 14 includes an aperture 18 which allows ions to escape the ion trap volume 19 and be detected by an appropriate detector 3. For example, an appropriate detector 3 can create a signal which is proportional to the number of ions exiting the ion trap. The mass spectrometer 11 can also include a lens 1 located between, for example, the end of an octopole ion guide 2, and the entrance endcap 13. The octopole ion guide 2 can guide ions, for example from an ion source 5, to the ion trap after creation, while the lens 1 can shield the incoming ions, within the ion guide 2, from the RF signal applied to the entrance endcap 13. Lens 1 can have a DC voltage applied by DC lens power supply 6, and the ion guide 2 can be powered by ion optics power supply 7. Once the incoming ions pass the shielding lens 1 and before they arrive at entrance endcap aperture 16, the incoming ions are affected by the voltages applied to the ring electrode 12 and entrance endcap electrode 13.

A fundamental RF generator 21 applies a suitable fundamental RF trapping voltage to the ring electrode 12 to generate trapping fields, within the ion trap, which trap ions over a predetermined m/z range of interest. A supplemental RF generator 23 can apply a supplemental RF voltage across the endcap electrodes, 13 and 14. A DC offset voltage can be applied to both endcap electrodes, 13 and 14, and to the ring electrode 12 by a DC offset voltage source 24, while an AC offset voltage can also be applied to both endcaps electrodes, 13 and 14, and to the ring electrode 12 by an AC offset generator 25. The AC offset, for example, could be any periodic time varying voltage with the same frequency as the fundamental RF frequency or a multiple or submultiple of the fundamental RF frequency. The DC offset and AC offset voltages are summed at node 26, for the ring electrode 12, and node 27, for the endcap electrodes, 13 and 14. Accordingly, the voltage applied to the ring electrode 12 is the sum of the fundamental RF voltage, the DC offset voltage, and the AC offset voltage, while the voltage applied to the endcaps, 13 and 14, is the sum of the supplementary RF voltage, the DC offset voltage, and the AC offset voltage.

The DC offset and AC offset should have little or no effect on the ions within the ion trap. By contrast, both the DC offset and AC offset will affect ions as they approach the ion trap. Specifically, the DC offset and AC offset can affect both the kinetic energy and/or arrival time of approaching ions. Also, the DC offset and AC offset can overcome any effects from RF fields which penetrate out the entrance endcap aperture 16 from voltages applied to the ring electrode 12. Furthermore, the effect on the ions from the AC offset varies as a function of the phase of the AC offset. If, for example, the frequency of the AC offset voltage is the same as the frequency of the fundamental RF trapping voltage applied to the ring electrode, then the effect on the kinetic energy and/or arrival time of approaching ions will vary as a function of the phase of the fundamental RF trapping voltage.

In another embodiment, if the AC offset generator 25 is at the same frequency as the fundamental RF generator 21, then the summing node 26 can be eliminated. It is well known that the sum of two sinusoids of the same frequency with different phase offsets is simply another sinusoidal wave having the same frequency and a different amplitude and/or phase offset. Therefore, by adjusting the amplitude and phase offset of the fundamental RF generator 21 and the AC offset generator 25, the voltage applied to the ring electrode 12, without the summing node 26, can be made equivalent to that with the summing node 26 in place. In additional embodiments, where the frequency of the AC offset voltage is not the same as the frequency of the fundamental RF trapping voltage, for example, a multiple or submultiple of the fundamental RF trapping voltage, summing node 26 can still be eliminated and adjustments made to the amplitude, phase offset, and frequency of the fundamental RF generator 21 resulting in the voltage applied to the ring electrode 12, without the summing node 26, being equal to the voltage which would have been applied with summing node 26 in place.

Figure 1B:
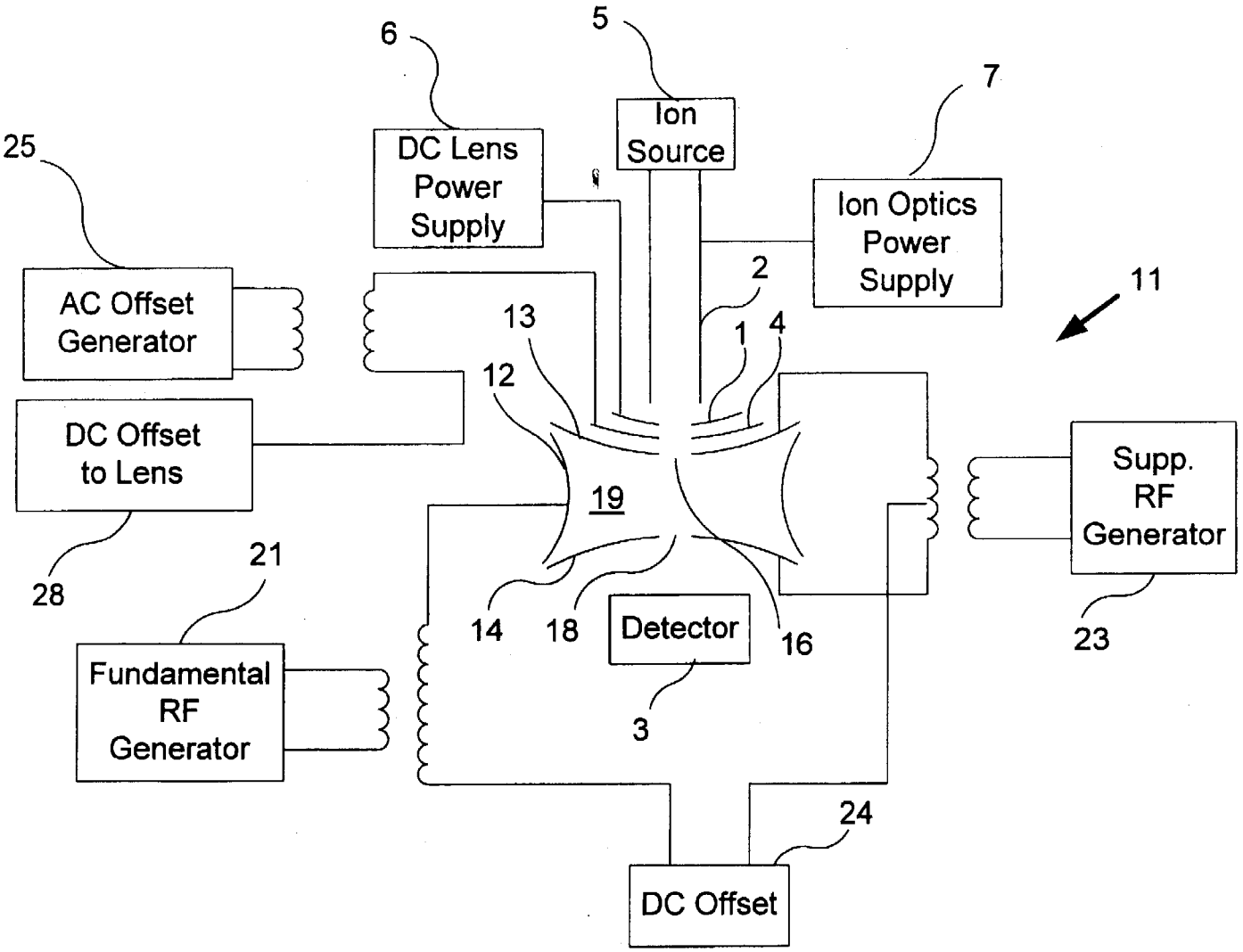
FIG. 1B shows a cross-section of an additional embodiment of a quadrupole ion trap mass spectrometer where an AC offset time varying voltage is applied to a lens in accordance with the subject invention.
Figures 2A, 2B, 2C, 2D, 2E, 2F:
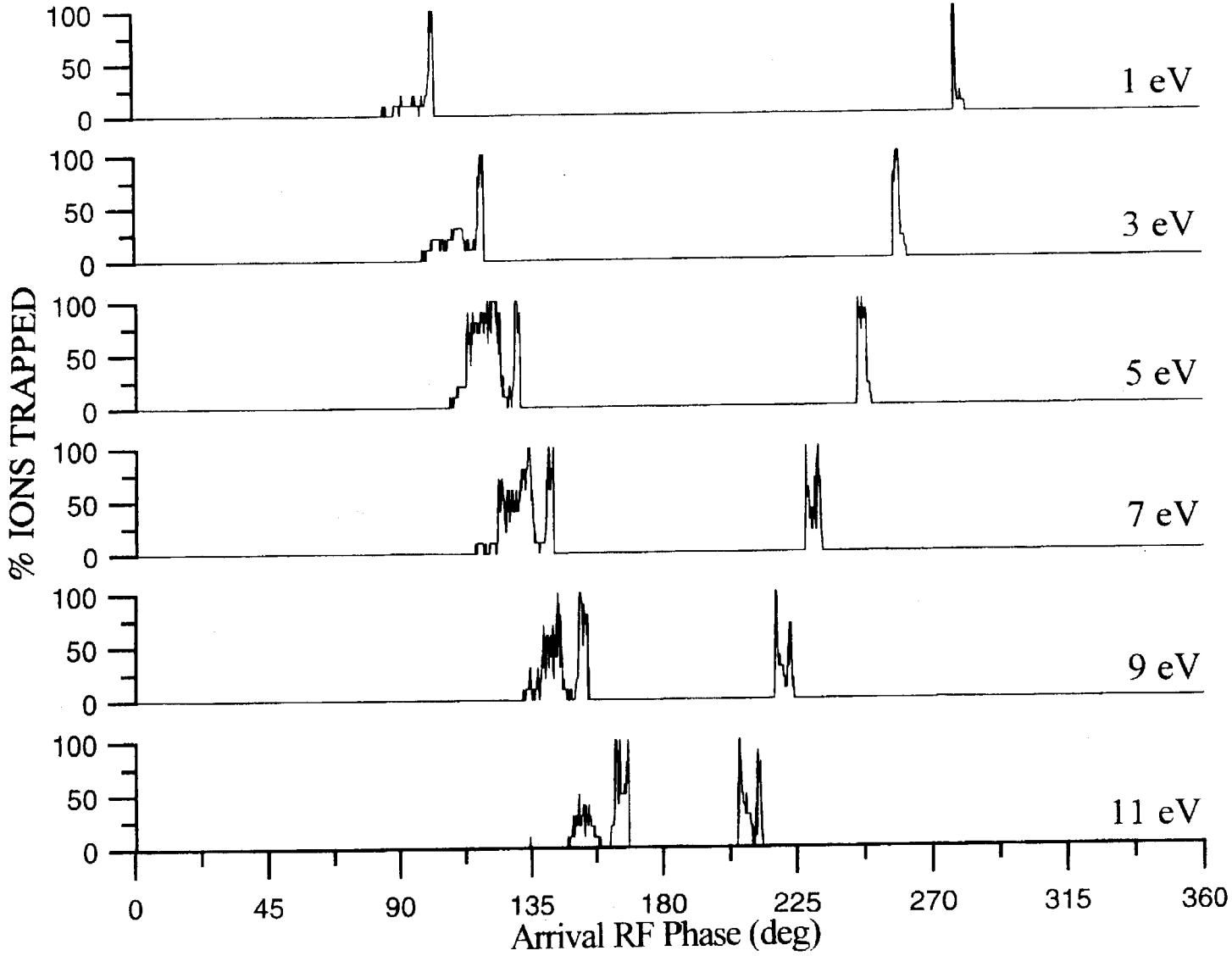
FIG. 2A shows the percentage of ions trapped versus arrival RF phase angle for ion injection simulations for m/z 100, injected at a $q_z$=0.25, with initial kinetic energy of 1 eV.
FIG. 2B shows the percentage of ions trapped versus arrival RF phase angle for ion injection simulations for m/z 100, injected at a $q_z$=0.25, with initial kinetic energy of 3 eV.
FIG. 2C shows the percentage of ions trapped versus arrival RF phase angle for ion injection simulations for m/z 100, injected at a $q_z$=0.25, with initial kinetic energy of 5 eV.
FIG. 2D shows the percentage of ions trapped versus arrival RF phase angle for ion injection simulations for m/z 100, injected at a $q_z$=0.25, with initial kinetic energy of 7 eV.
FIG. 2E shows the percentage of ions trapped versus arrival RF phase angle for ion injection simulations for m/z 100, injected at a $q_z$=0.25, with initial kinetic energy of 9 eV.
FIG. 2F shows the percentage of ions trapped versus arrival RF phase angle for ion injection simulations for m/z 100, injected at a $q_z$=0.25, with initial kinetic energy of 11 eV.

In an alternative embodiment, referring to FIG. 1B, an AC voltage can be applied to at least one lens 4, for example a cone-shaped lens, located outside of the entrance endcap 13 of the ion trap to vary the potential in and around the entrance endcap aperture 16. By varying the potential in and around the endcap aperture 16, the kinetic energy and/or arrival time of injected ions can be altered to increase the trapping efficiency of the ion trap. The AC offset can overcome any effects from RF fields which penetrate out the entrance endcap aperture 16 from voltages applied to the ring electrode 12. In this embodiment, at least one AC offset generator 25 can supply at least one AC offset voltage to at least one lens 4 located outside the entrance endcap aperture 16. Each lens 4 can have a different lens DC offset supplied by different DC offset voltage sources 28. In addition, a fundamental RF generator 21 can supply the RF trapping voltages to the ring electrode 12, a trap DC offset voltage source 24 can supply a trap DC offset to the ring 12 and endcap 13 and 14 electrodes, and a supplementary RF generator 23 can supply a supplementary RF voltage across the endcap electrodes 13 and 14. The lens 1 can shield the incoming ions, within the ion guide 2, from the RF signal applied to at least one lens 4 outside the entrance endcap 13. The trap DC offset, lens DC offset, and lens AC offset should have little or no effect on the ions within the ion trap. By contrast, the trap DC offset, lens DC offset, and lens AC offset will affect ions as they approach the ion trap. Specifically, the trap DC offset, lens DC offset, and lens AC offset can affect both the kinetic energy and/or arrival time of ions when they reach the entrance endcap. The lens AC offset, for example, could be any time varying voltage with the same frequency as the fundamental RF frequency or a multiple or submultiple of the fundamental RF frequency.

Computer Simulations. Our simulations used an RF level corresponding to a $q_z$ of 0.25 applied to the ring electrode. In a specific simulation, ions of m/z 100 were started at the inner plane of the entrance endcap electrode in the center of the endcap hole. The ions were started with various kinetic energies and a direction 5° from the normal. A one-dimensional Monte Carlo hard-sphere collision model was used to model the random collisions with 1.5 mtorr of helium buffer gas. Because the collision model was based on randomly computed distances between collisions, reseeding the random number generator for each of a series of ions produced statistical information on the percentage of ions that were trapped under various conditions. In this simulation, 10 ions were injected with different random number generator seeds at each set of conditions. FIGS. 2A–2F show the results of several computer ion injection simulations for m/z 100, injected at a $q_z$=0.25, with initial kinetic energies ranging from 1 to 11 eV. Six plots are shown for different initial kinetic energies between 1 and 11 eV. Each plot shows the percentage of ions trapped versus the arrival RF phase angle from a population of 10 ions injected at each starting RF phase angle between 0° and 360° in 1° increments. Since the ions were started at the inner plane of the entrance endcap, the starting RF phase angle is the arrival RF phase angle. The following equations were used to apply the voltages to the ring electrode and the two endcap electrodes:

$$V_{Ring\ Electrode} = \frac{-q_z m(r_o^2 + 2z_o^2)\Omega^2}{8e} \sin(\Omega t + \Phi) + V_{DC\ Offset}$$

$$V_{Endcap\ Electrodes} = V_{DC\ Offset}$$

Ω=angular frequency of fundamental RF trapping voltage applied to ring electrode $V_{DC\ Offset}$=amplitude of DC offset applied to ring and endcap electrodes $\Phi$=starting RF phase angle $r_o$=radius of the ring electrode $Z_o$=distance from the center of the ion trap to the closest point on the endcap electrodes ps At each kinetic energy, only a narrow range of arrival RF phase angles result in efficient trapping of injected ions. Also note that different arrival RF phase angles are favorable for each initial kinetic energy.

Figure 3:
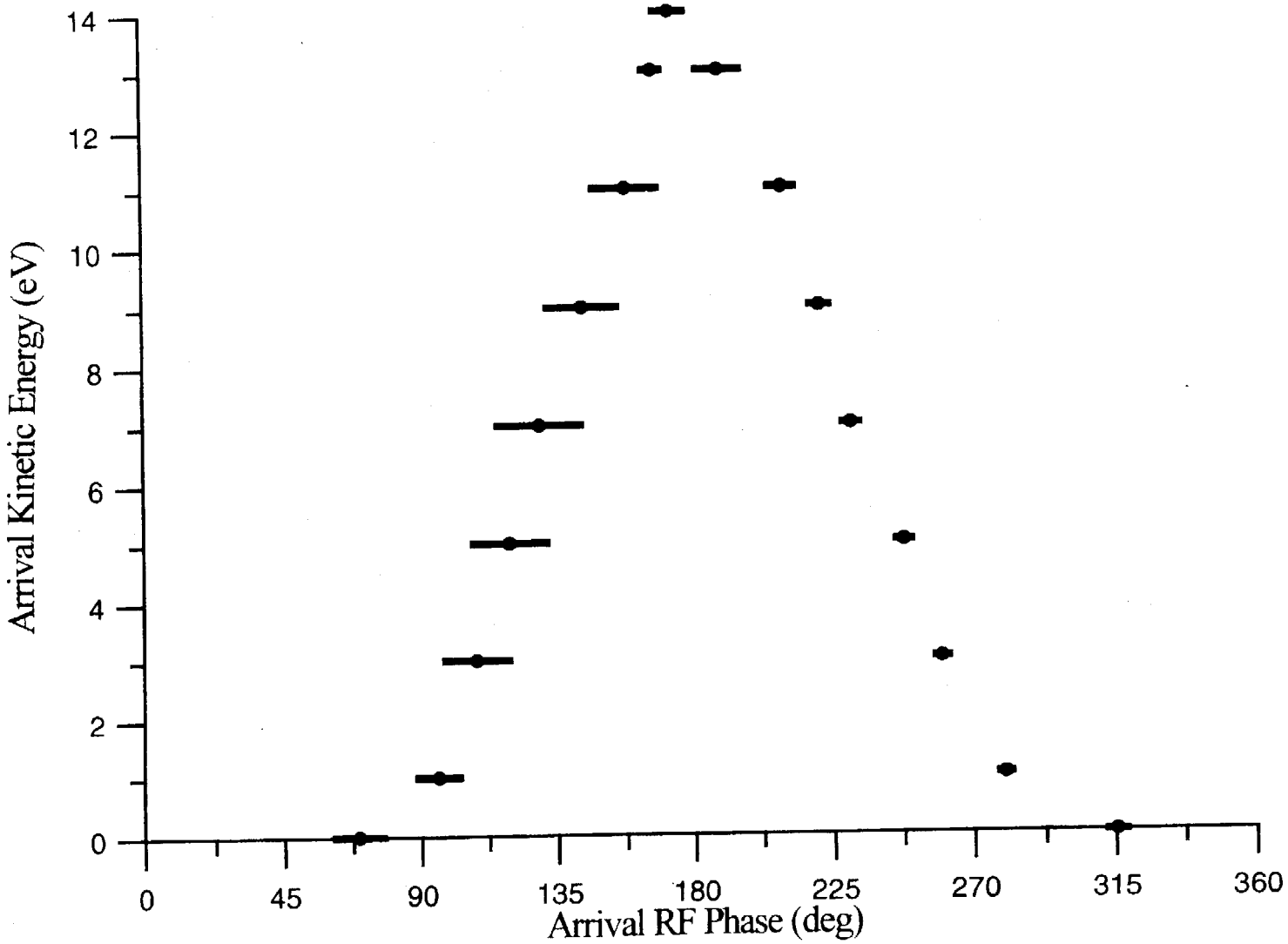
FIG. 3 shows a simulation of the relationship between the kinetic energy of injected ions which are trapped and arrival RF phase angle.

The data from these simulations are summarized in FIG. 3 where the arrival kinetic energy, of injected ions which are trapped, is plotted versus their arrival RF phase angle. The horizontal bands indicate the range of RF phase angles over which ions were successfully trapped for that particular kinetic energy. By varying the kinetic energy of injected ions in relation to the RF phase angle at which the ions enter the ion trap, it is possible for ions to enter the trap with the appropriate kinetic energy to be trapped over a wider range of RF phase angles than can be obtained with constant kinetic energy introduction.

In order to investigate the effects of field penetration and ion momentum, a simulation was next set up to determine if it is possible to affect the kinetic energy of ions entering the ion trap on the time scale of the RF period. For this simulation, ions were started outside the ion trap in the octopole ion guide and then injected, rather than being started at the surface of the endcap electrode. The simulation was set up to allow DC and AC offset voltages to be applied to the ring electrode and the endcaps electrodes in addition to the standard RF voltage applied to the ring electrode. The following equations were used to apply the voltages to the ring electrode and the two endcap electrodes:

$$V_{Ring\ Electrode} = \frac{-q_z m(r_o^2 + 2z_o^2)\Omega^2}{8e} \sin(\Omega t + \Phi) + V_{DC\ Offset} + V_{AC\ Offset} \sin(\Omega t + \Phi + \phi_{AC})$$

$$V_{Endcap\ Electrodes} = V_{DC\ Offset} + V_{AC\ Offset} \sin(\Omega t + \Phi + \phi_{AC})$$

Figures 4A, 4B, 4C:
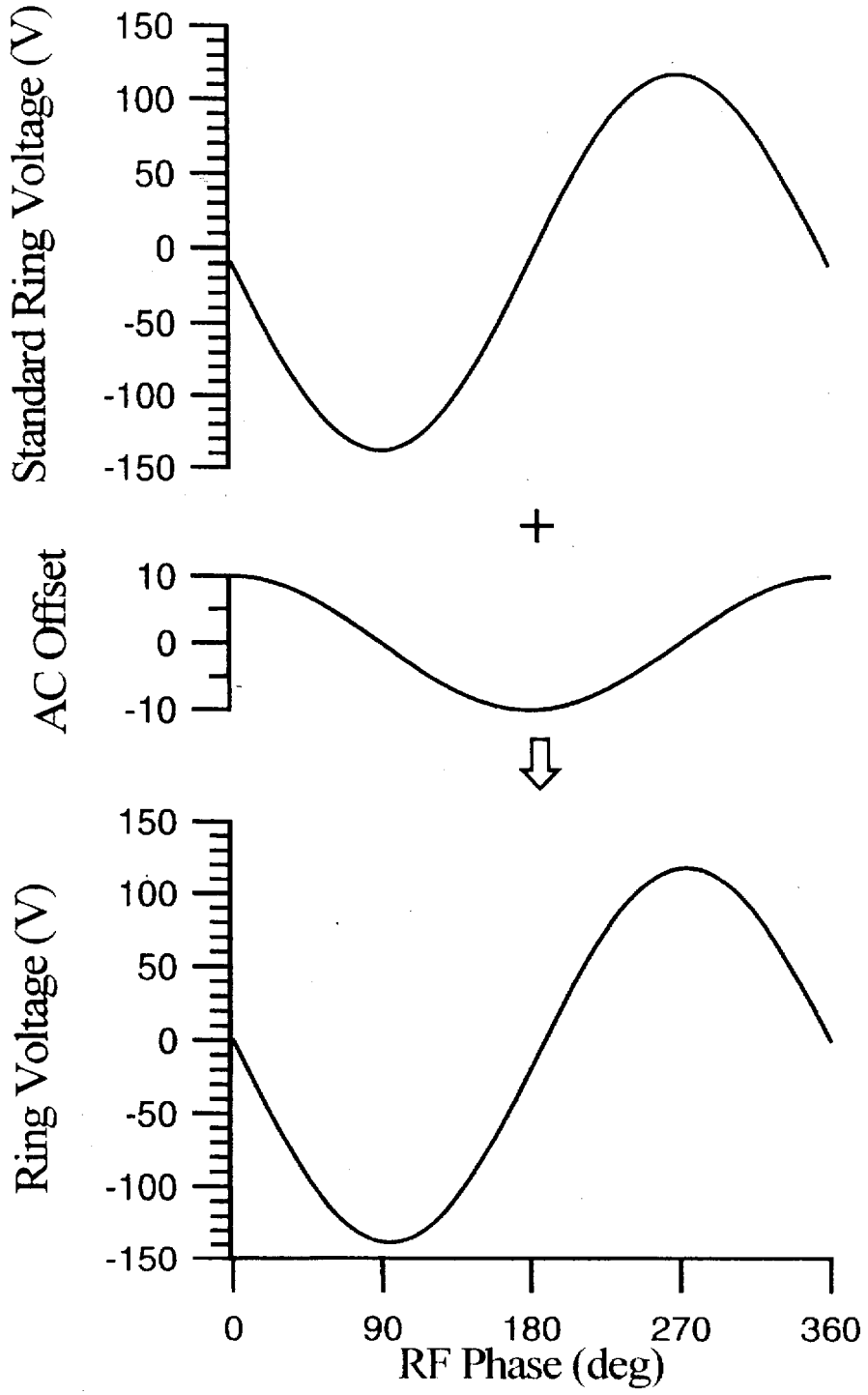
FIG. 4A shows an example of the standard ring voltage which would be applied to the ring electrode to create trapping fields.
FIG. 4B shows an example of the AC offset voltage which would be applied to the ring electrode to maintain appropriate trapping fields when the same AC offset is applied to the end cap electrodes.
FIG. 4C shows an example of the voltage, being the summation of the voltages shown in FIGS. 4A and 4B, which is applied to the ring electrode in accordance with the subject invention.
Figures 4D, 4E, 4F:
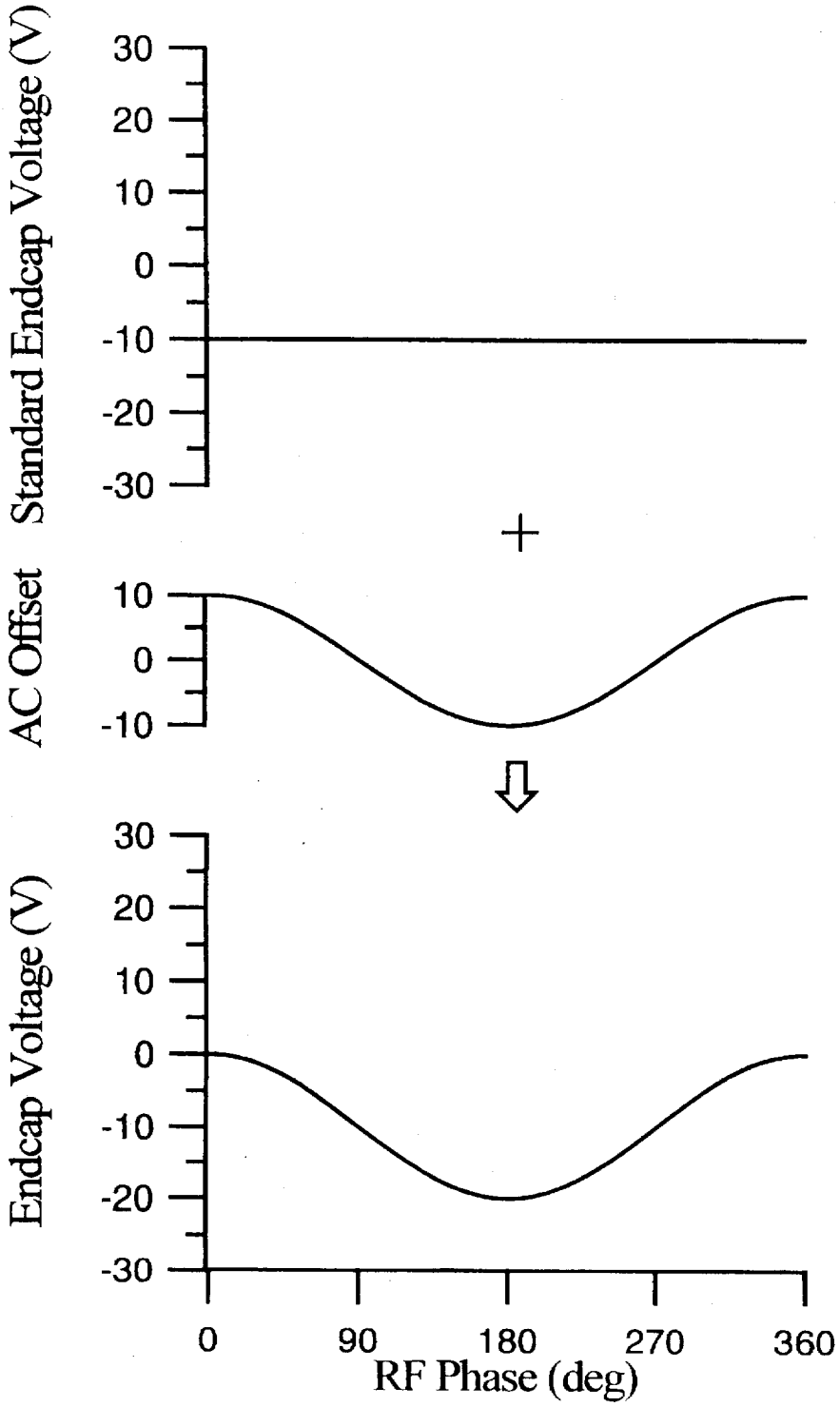
FIG. 4D shows an example of the standard endcap voltage which would be applied to the endcap electrodes to create trapping fields.
FIG. 4E shows an example of the AC offset voltage which would be applied to the endcap electrodes to alter the kinetic energy and/or arrival time of incoming ions.
FIG. 4F shows an example of the voltage, being the summation of the voltages shown in FIGS. 4D and 4E, which is applied to the endcap electrodes in accordance with the subject invention.
Figure 5B:
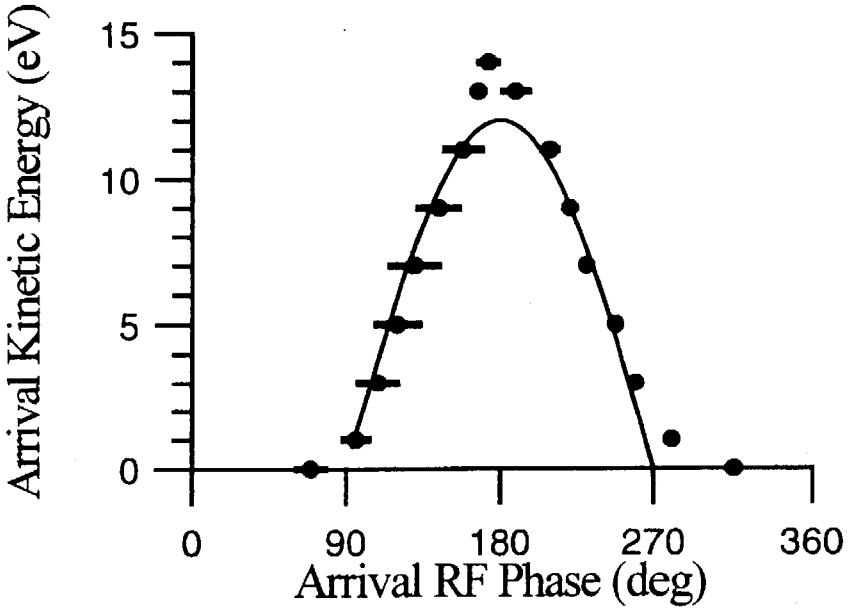
FIG. 5B shows the expected variation (solid curve) of arrival kinetic energy of ions as a function of the arrival RF phase angle, with an AC offset applied and assuming no effects from field penetration or ion momentum, superimposed on FIG. 3.
Figure 5A:
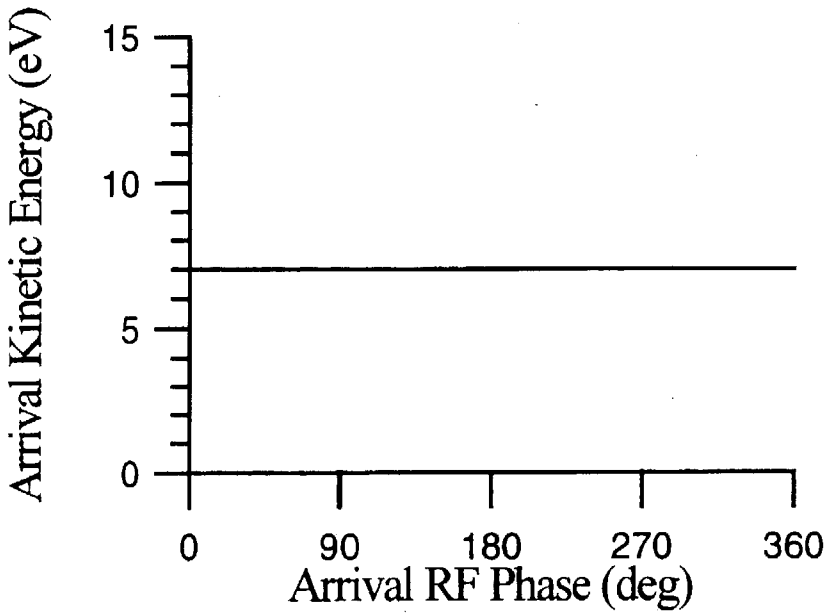
FIG. 5A shows the expected variation of arrival kinetic energy of ions as a function of the arrival RF phase angle, with no AC offset and assuming no effects from field penetration or ion momentum.

$V_{Ac\ Offset}$=amplitude of AC offset applied to ring and endcap electrodes $\phi_{AC}$=phase difference between the fundamental RF trapping voltage and the AC offset applied to ring and endcap electrodes FIGS. 4A–4F show how these time varying voltages are applied to the ring and endcap electrodes. FIGS. 4A and 4D show an example of the voltages applied to the ring electrode and endcap electrodes, respectively, in the normal mode of operation. FIGS. 4C and 4F show examples of the voltages applied to the ring electrode and endcap electrodes, respectively, once the AC offset (FIGS. 4B and 4D) is added to vary the trap offset with RF phase angle. One complete RF period is shown. Since the potential of the ion trap is now a function of RF phase angle, the kinetic energy of ions as they enter the ion trap should also be a function of RF phase angle. If there were no effects from field penetration of the fundamental RF out of the endcap hole or ion momentum, the kinetic energy of ions entering the trap with and without the AC offset would be as shown in FIGS. 5A and 5B with the solid lines. FIG. 5A is for the standard case of $V_{DC\ Offset}$=−10 V and $V_{Ac\ Offset}$=0 $V_p$, where FIG. 5B is for case with AC offset added, $V_{DC\ Offset}$=−3 V, $V_{AC\ Offset}$=12 $V_p$, and $\phi_{AC}$=90°. The desired values for the kinetic energy and RF phase of the ions as they cross the inner plane of the entrance endcap is shown as ● symbols. These desired values for kinetic energy and RF phase are the same as shown in FIG. 3. The arrival kinetic energy was calculated by subtracting the potential of the ion trap at that particular RF phase (the potential is the sum of the $V_{DC\ Offset}$ and $V_{AC\ Offset}$) from the starting potential of the ion beam. In this case the starting potential of the ions was −3 V. In the standard case, with no effects from RF field penetration or ion momentum, ions would cross the inner plane of the entrance endcap with constant kinetic energy. However, when this set of voltages was applied in an ion injection simulation it was found that because of field penetration of the RF voltage out of the ion trap and ion momentum which resisted fast changes in kinetic energy, this kinetic energy profile was not obtained. Other combinations of $V_{Dc\ Offset}$, $V_{AC\ Offset}$, and $\phi_{AC}$ were studied to determine what combinations would yield the desired kinetic energy/phase relationship shown in FIG. 3.

Figure 6:
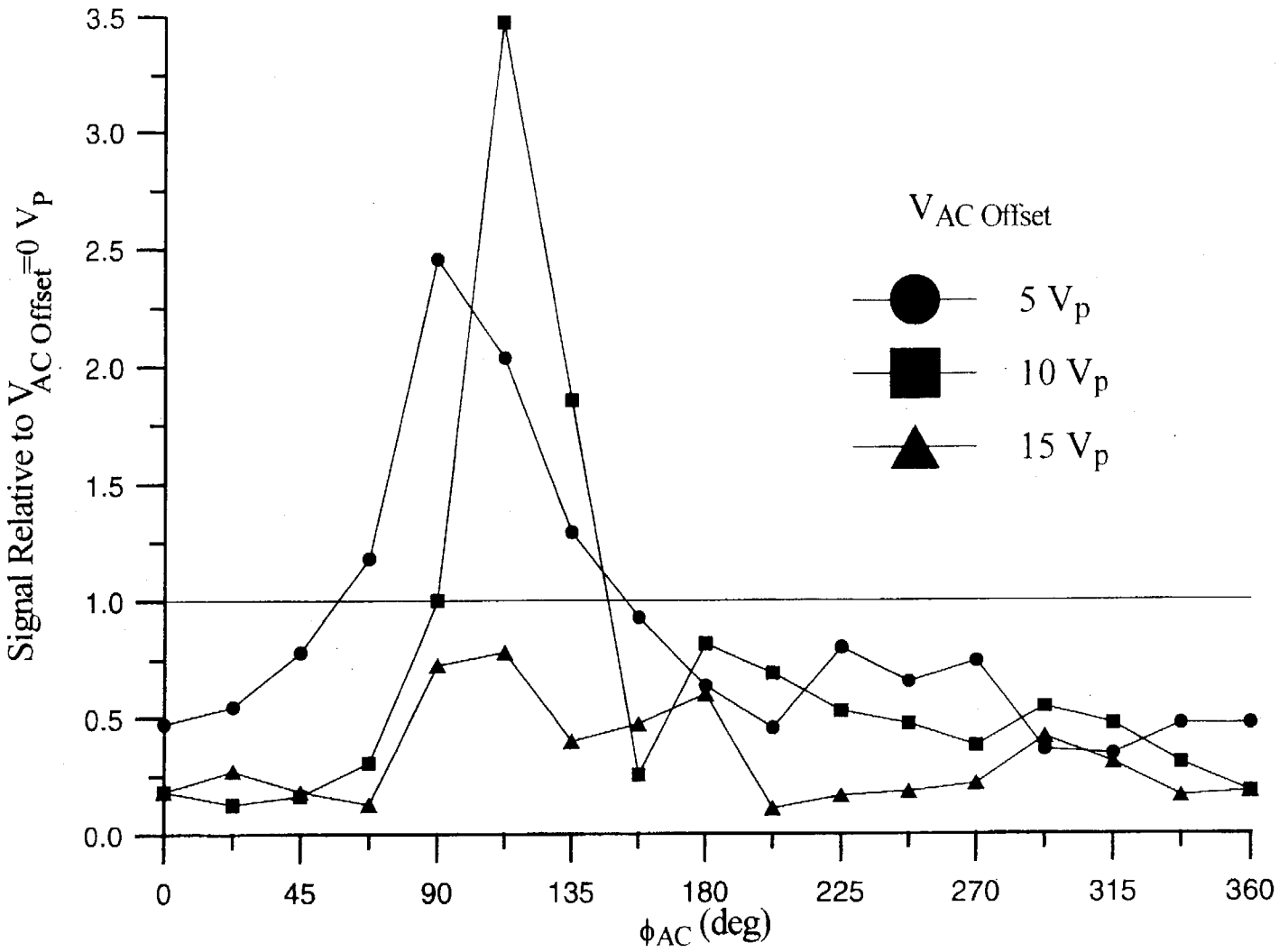
FIG. 6 shows the relative trapping efficiency versus $\phi_{AC}$ for three different $V_{AC\ Offset}$ values and $V_{DC\ Offset}$=−10 V (relative to 1.0 for $V_{DC\ Offset}$=−10 V and $V_{AC\ Offset}$=0 $V_p$).

The next simulations started a series of ions 11.15 mm from the inner endcap plane at starting RF phase angles between 0° and 360° in 1° increments. To determine the effect of the AC offset applied to the ion trap on ions entering the ion trap, the phase of the fundamental RF and the kinetic energy of the ions were recorded as the ion crossed the inner plane of the entrance endcap ($z=z_o$) for different combinations of $V_{DC\ Offset}$, $V_{AC\ Offset}$, and $\phi_{AC}$. These data could then be compared to the desired kinetic energy versus RF phase angle relationship shown in FIG. 3. Recall that the data in FIGS. 2A–2F and 3 were generated for ions started at this inner endcap plane ($z=z_o$). The system of three variables ($V_{DC\ Offset}$, $V_{AC\ Offset}$, and $\phi_{AC}$) is complex and not completely mapped, as only a small number of combinations were simulated. In this simulation, the starting RF phase angles for which ions were successfully trapped were recorded (trapped as defined by ions undergoing stable trajectories for at least 400 μs in the presence of a simulated buffer gas pressure of 1.5 mtorr of helium). For these simulations the DC offset voltage on the octopole ion guide 2 (referring to FIG. 1A) was −6.5 V. The voltage on the lens 1 outside the entrance endcap 13 was −8 V. The $V_{DC\ Offset}$ was −10 V. Varying $V_{AC\ Offset}$ and $\phi_{AC}$ and plotting the percentage of ions trapped over all starting RF phase angles allowed a quantitative comparison of the merit of varying the ion trap offset with RF phase angle. In FIG. 6, the relative trapping efficiency (relative to the percentage of ions trapped for the standard case of $V_{DC\ Offset}$=−10 V, $V_{AC\ Offset}$=0 $V_P$) is plotted versus $\phi_{AC}$, for three different $V_{AC\ Offset}$ values. For the values tested, $V_{DC\ Offset}$=−10 V, $V_{AC\ Offset}$=10 $V_P$, and $\phi_{AC}$=112.5° resulted in a 3.5 times increase in trapping efficiency compared to the case where $V_{AC\ Offset}$=0 $V_p$. The reason this particular combination worked so well is demonstrated in FIGS. 7A, 7B, 8A, and 8B.

Figure 7B:
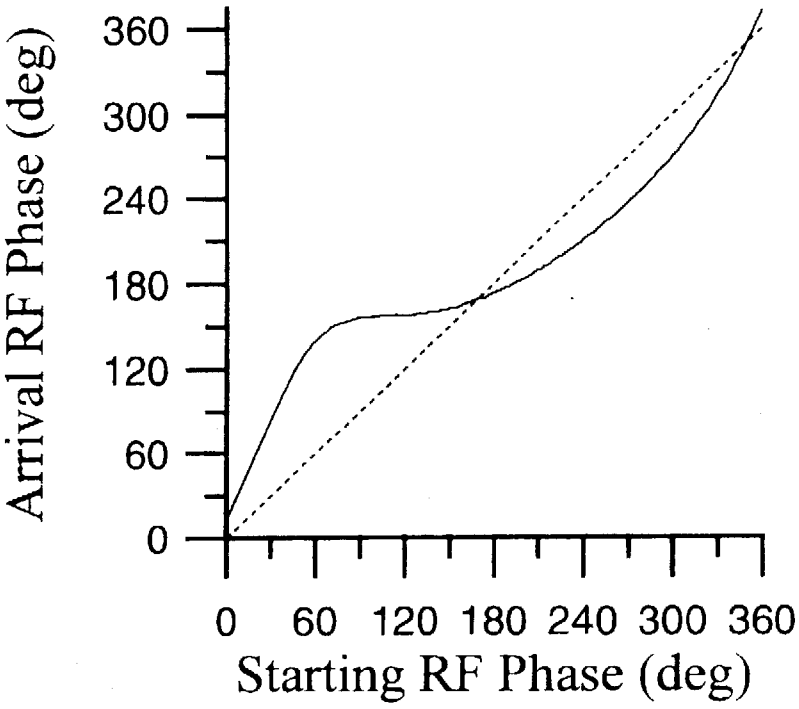
FIG. 7B shows the arrival RF phase angle versus the starting RF phase angle for ion injection simulation of m/z 100 injected at a $q_z$0.25 with $V_{DC\ Offset}$=−10 V, $V_{AC\ Offset}$=10 $V_p$, and $\phi_{AC}$=112.5°.
Figure 7A:
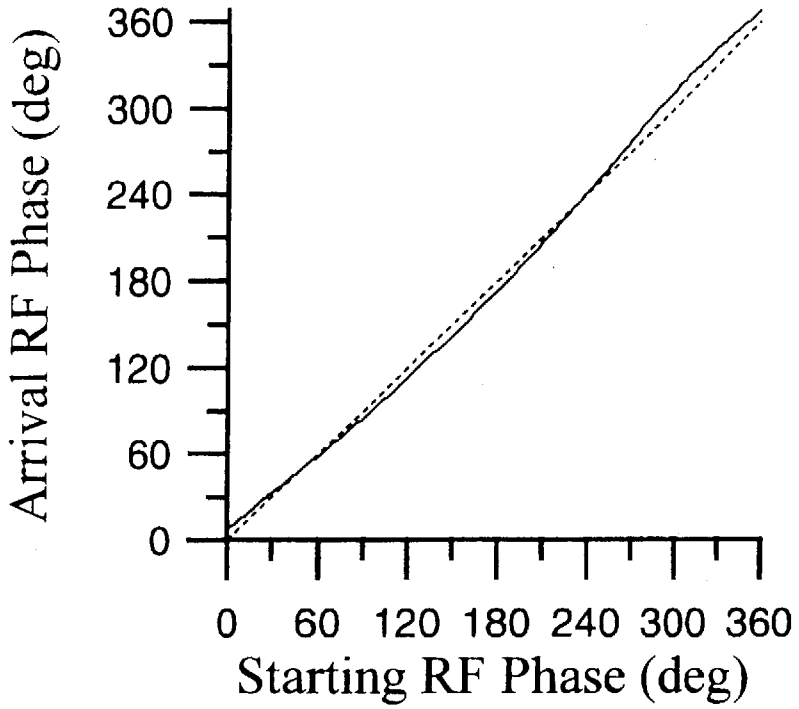
FIG. 7A shows the arrival RF phase angle versus the starting RF phase angle for ion injection simulation of m/z 100 injected at a $q_z$=0.25, with $V_{DC\ Offset}$=−10 V and $V_{AC\ Offset}$=0 $V_p$.

FIGS. 7A and 7B show the variation of the arrival RF phase angle with the starting RF phase angle for ions started outside the trap. FIG. 7A illustrates the standard operating case (with $V_{AC\ Offset}$=0 $V_p$) and FIG. 7B illustrates a particular case having a non-zero $V_{AC\ Offset}$. For this injection simulation of m/z 100 ions injected at $q_z$=0.25, the ions are started outside the ion trap 11.15 mm from the inner endcap plane at starting RF phase angles between 0° and 360°. The arrival RF phase is the RF phase angle at which each ion reaches the inner endcap plane. Ions in FIG. 7A reach the endcap at approximately a constant time delay (as indicated by proximity to the dotted 45° line); whereas many ions in FIG. 7B are slowed down or speeded up by the AC offset, manipulating the time at which they reach the endcap. Specifically, in FIG. 7A, the standard operating case of $V_{DC\ Offset}$=−10 V and $V_{Ac\ Offset}$=0 $V_p$, ions arrive at the ion trap an approximately constant time delay later. In FIG. 7B, for the case of $V_{DC\ Offset}$=−10 V, $V_{AC\ Offset}$=10 $V_p$, and $\phi_{AC}$=112.5°, most ions are slowed down or speeded up such that they arrive at the ion trap at very different times. This results in the ions not arriving in a uniform, continuous beam.

Figure 8A:
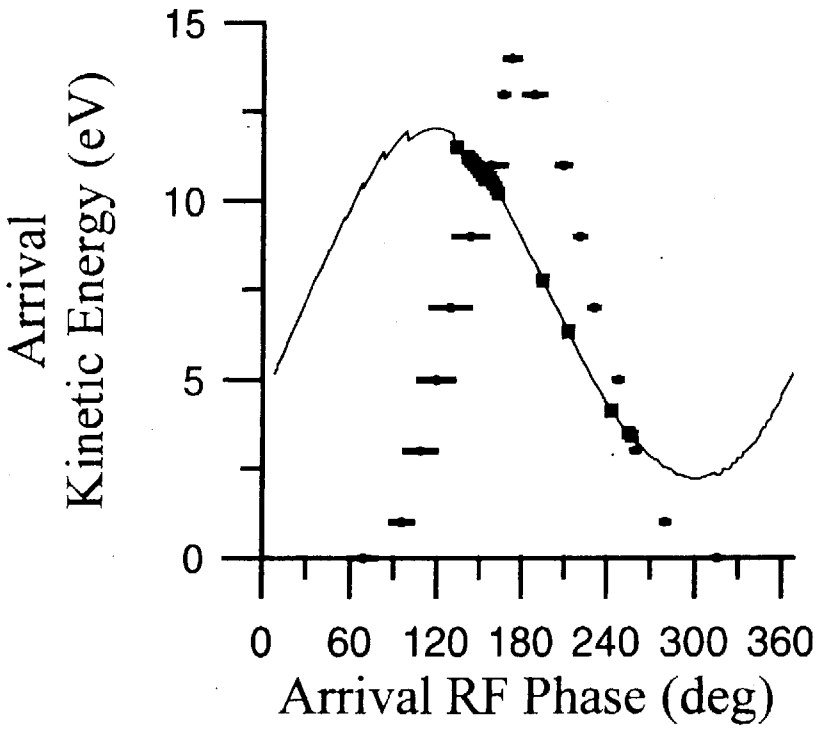
FIG. 8A shows the arrival kinetic energy versus the arrival RF phase angle for ion injection simulation of m/z 100 injected at a $q_z$=0.25 with $V_{DC\ Offset}$=−10 V and $V_{AC\ Offset}$=0 $V_p$, superimposed on FIG. 3.
Figure 8B:
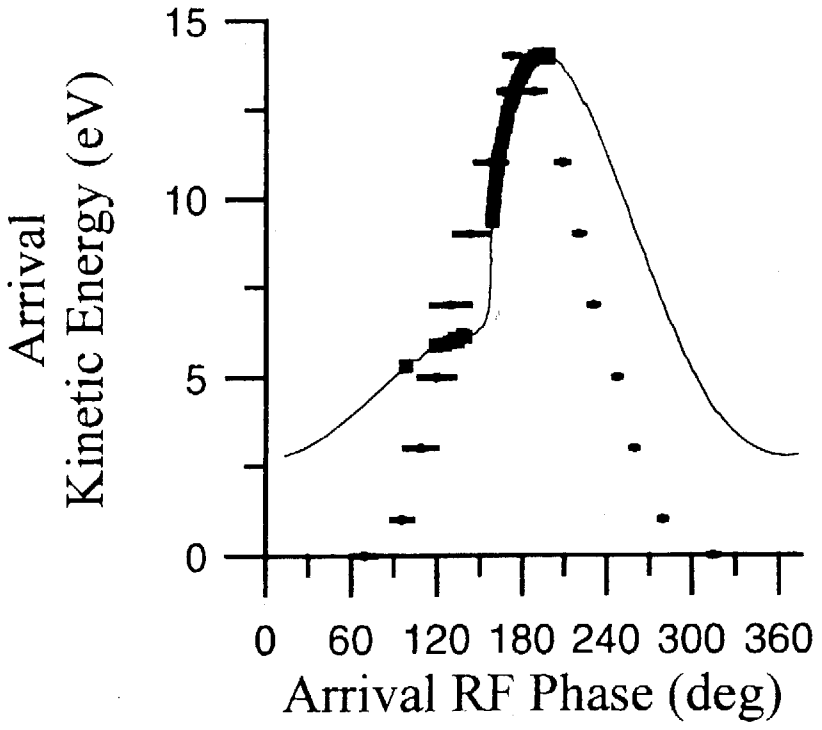
FIG. 8B shows the arrival kinetic energy versus the arrival RF phase angle for ion injection simulation of m/z 100 injected at a $q_z$=0.25 with $V_{DC\ Offset}$=−10 V, $V_{AC\ Offset}$=10 $V_p$, and $\phi_{Ac}$=112.5°, superimposed on FIG. 3.

FIGS. 8A and 8B illustrate the effect of the AC offset voltage on arrival kinetic energy. The m/z 100 ions are started outside the ion trap 11.15 mm from the inner endcap plane at starting RF phase angles between 0° and 360°. Here the arrival kinetic energy is plotted as a solid line versus the arrival RF phase angle. In other words, this shows what kinetic energy the ions have and at what RF phase angle they reach the endcap plane. By comparing these to the data in FIG. 3 (shown as solid circles and horizontal bands in FIGS. 8A and 8B) we see that the use of an AC offset produces an arrival kinetic energy profile more closely resembling that which is desired for increasing the range of RF phase angles which can be trapped. In fact, the ■ symbols shown in FIGS. 8A and 8B indicate which phase angles resulted in successfully trapping ions. FIG. 8B shows that more RF phase angles resulted in trapped ions with the use of an AC offset. Presumably, different combinations of $V_{DC\ Offset}$, $V_{Ac\ Offset}$ and $\phi_{AC}$ will produce an ion beam which enters the ion trap with a kinetic energy profile which even more closely resembles that in FIG. 3. It should also be possible to use non-sinusoidal AC offset voltages to vary the kinetic energy and/or arrival RF phase. These AC offsets would have the same frequency as the fundamental RF frequency, or a multiple or submultiple of it. This should allow even more control over the kinetic energy profile and make it possible to trap even more ions.

Experimental Results

Figure 9:
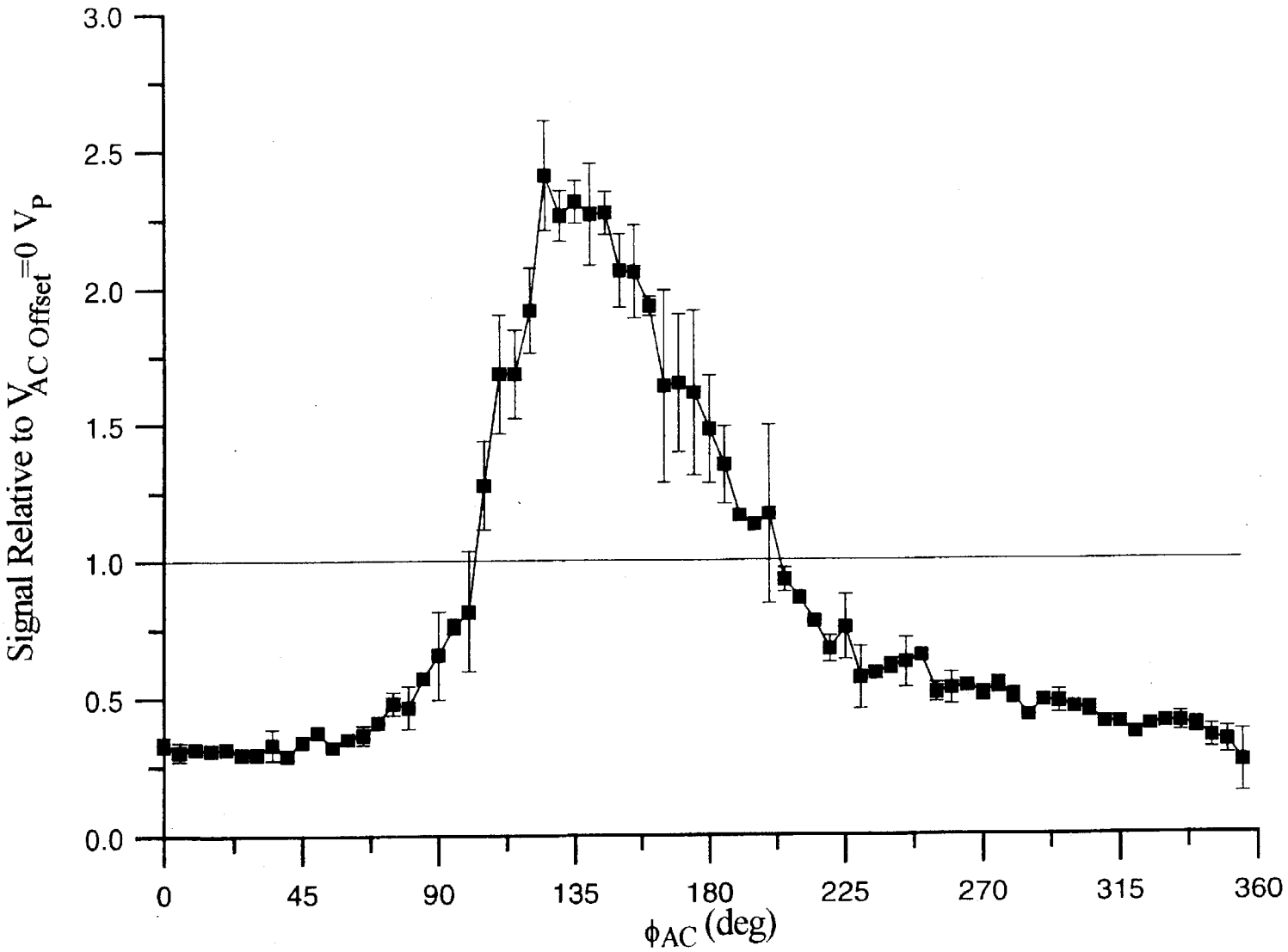
FIG. 9 shows experimental results of the relative trapping efficiency versus $\phi_{AC}$ for $V_{DC\ Offset}$=−10 V and $V_{AC\ Offset}$=10 $V_p$ (relative to 1.0 for $V_{DC\ Offset}$=−10 V and $V_{AC\ Offset}$=0 $V_p$).

FIG. 9 shows the results of an experiment where a DC offset of −10 V and an AC offset of 10 $V_P$ were applied and a detection signal, proportional to the trapping efficiency, was measured. This detection signal was compared to a corresponding detection signal for a DC offset of −10 V and an AC offset of 0 $V_p$. Referring to FIG. 1A, DC offset of −6.5 V was applied to the octopole ion guide 2 and −8 V was applied to a lens 1 outside the entrance endcap 13. Ions were started at a potential of −3 V. Ions of m/z 106, $[M+H]^+$ ions of L-serine, were formed by electrospray ionization and injected into the ion trap. The fundamental RF voltage applied to the ion trap corresponded to a $q_z$=0.297. For $\phi_{AC}$, the phase difference between the AC offset voltage and the fundamental RF trapping voltage applied to the ring electrode 12, between approximately 105° and 200° the signal corresponding to an AC offset of 10 $V_p$ is greater than the signal corresponding to an AC offset of 0 $V_p$. This indicates that for $\phi_{AC}$ between approximately 105°–20° the trapping efficiency was enhanced by applying an AC offset of 10 $V_p$. These experimental results show an improvement in trapping efficiency similar to what was seen in computer simulations of ion injection in FIG. 6 (although at a different $q_z$ value). Presumably, the addition of the AC offset has the desirable effect of altering the arrival kinetic energy and the arrival RF phase making it possible for more ions to be trapped. Using these AC offset voltages to vary the kinetic energy and the arrival RF phase of the ion beam can improve the trapping efficiency of ions.

To obtain the maximum possible improvement in trapping efficiency, the $\phi_{AC}$, AC offset, and DC offset must be adjusted for the particular $q_z$, m/z ion, and instrumental setup being used. Our experimental setup included a short cone-shaped lens 1 placed outside the entrance endcap. It included a 0.060 inch diameter orifice (the same as the endcap hole) and was situated 0.030 inches from the back of the endcap electrode. DC offsets selected so that ions enter the ion trap with 5 to 20 eV of kinetic energy worked well. Typically, AC offsets of 5 to 15 $V_P$ provided the largest improvements in trapping efficiency for the m/z 106 ion studied. However, for higher m/z ions when larger RF voltages are applied to the ring electrode 12, larger AC offset voltages are necessary to affect the field near the entrance endcap aperture 16 and improve trapping efficiency. Overall, the most important parameter to adjust is $\phi_{AC}$. The optimum $\phi_{AC}$ may vary with, for example, $q_z$, ion m/z, and AC offset voltage.

The design of the lens 1 placed outside the entrance endcap can be important. Without the lens, the improvements in trapping with the AC offset applied to the ring and endcap electrodes have been small (<2 at m/z 106). Results indicate that the distance between the lens and the endcap may be important in obtaining the maximum improvement in trapping efficiency. In a specific embodiment, the lens is placed as close as possible to the entrance endcap aperture. The lens 1 shields ions from the AC offset on the entrance endcap 13; ions are not affected by the AC offset until they are close to the ion trap. If the ions are given too much distance to interact with the AC offset, they can be repelled and lost rather than just slowed down or speeded up as they enter the ion trap. By affecting them over a shorter distance, higher AC offset amplitudes can be used to change the ions' kinetic energies, but because this change occurs close to the entrance endcap 13, the arrival time would not be greatly affected. In another embodiment, ion optics systems could affect the arrival time without significantly disturbing the arrival kinetic energy of the ions. To take advantage of the arrival kinetic energy versus arrival RF phase relationship shown in FIG. 3, it may be necessary to affect both the kinetic energy and arrival time of the ion beam. Any manipulation of the ion beam must compensate for the effect of the RF voltage applied to the ring electrode 12 penetrating out of the entrance endcap aperture 16.

Figure 10:
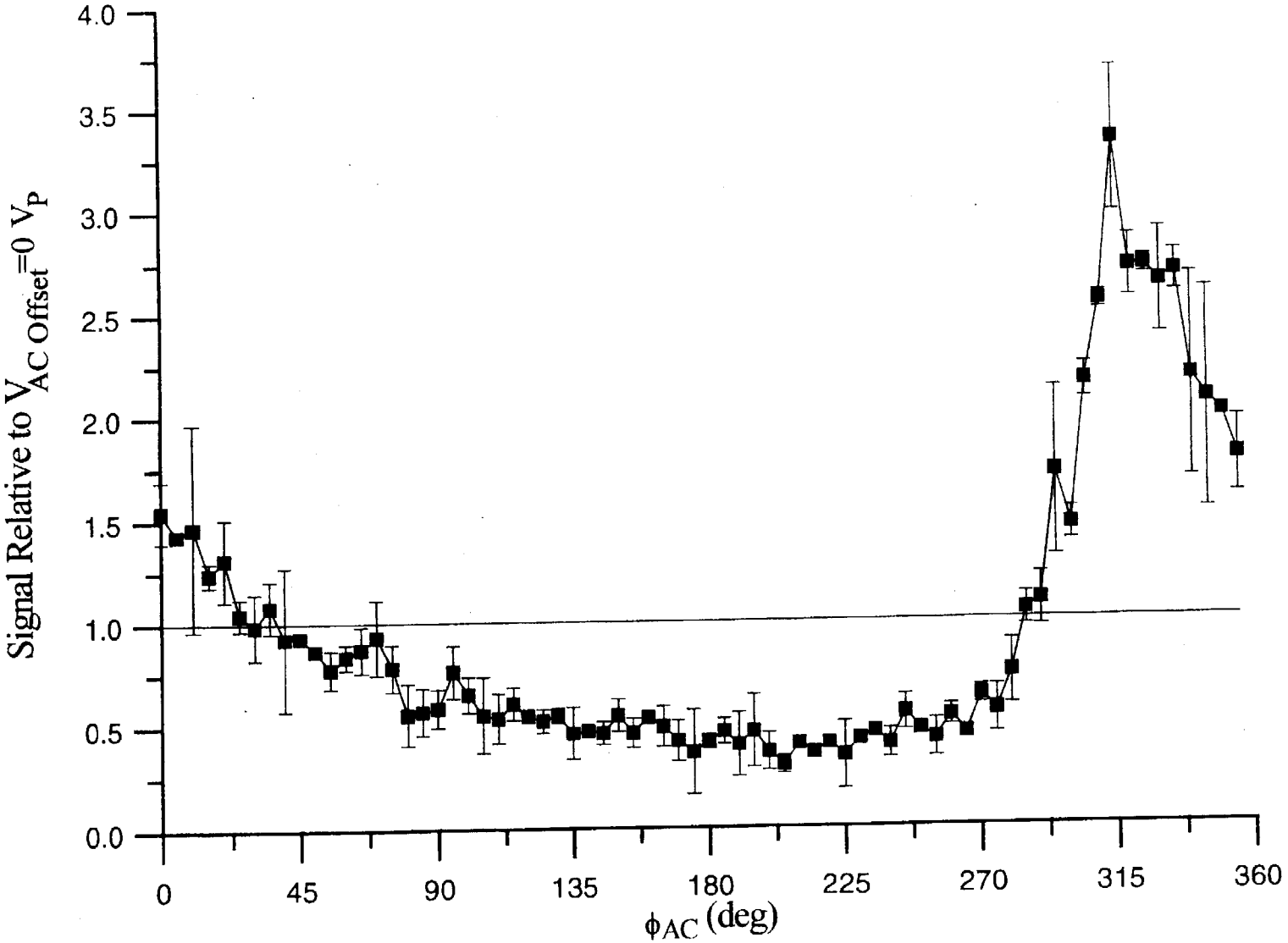
FIG. 10 shows experimental results of the relative trapping efficiency versus $\phi_{AC}$ for $V_{DC\ Offset}$=−10 V placed on the ring and endcap electrodes, $V_{DC\ Offset}$=−12 V placed on the lens outside the entrance endcap, and $V_{AC\ Offset}$=8 $V_p$ (relative to 1.0 for $V_{DC\ Offset}$=−10 V on the ring and endcap electrodes, $V_{DC\ Offset}$=−12 V on the lens, and $V_{Ac\ Offset}$=0 $V_p$).

The AC offset does not have to be applied to the ring 12 and endcap electrodes 13, 14 to vary the arrival kinetic energy and/or arrival RF phase of injected ions. FIG. 10 shows the result of an experiment where an AC offset of 8 $V_p$ was applied to the cone-shaped lens 4, (see FIG. 1B), outside the entrance endcap 13 described above. A DC offset of −10 V was placed on the ring 12 and endcap electrodes 13, 14 and a DC offset of −12 V was placed on the lens 4 outside the entrance endcap. In this experiment, lens 1 was not included. The detection signal was compared to a corresponding detection signal for an AC offset of 0 $V_P$ applied to the lens 4 outside the entrance endcap 13. The fundamental RF voltage applied to the ion trap corresponded to a $q_z$=0.297. For $\phi_{AC}$ between approximately 285° and 35° the signal corresponding to an AC offset of 8 $V_p$ is greater than the signal corresponding to an AC offset of 0 $V_p$. This indicates that for $\phi_{AC}$ between approximately 285° and 35° the injection efficiency was enhanced by applying an AC offset of 8 $V_p$ to the lens 4 outside the entrance endcap 13. The addition of the AC offset to the lens 4 outside the entrance endcap 13 has the desirable effect of altering the arrival kinetic energy and the arrival RF phase making it possible for more ions to be trapped. Using these AC offset voltages to vary the kinetic energy and the arrival RF phase of the ion beam can improve the trapping efficiency of ions.

FIG. 8A shows that in the normal operation of the ion trap, ions are accelerated or decelerated as they enter the ion trap by the RF voltage applied to the ring electrode 12. This RF voltage penetrates out the entrance endcap aperture 16 and affects ions as they approach, causing them to arrive with a kinetic energy that is a function of RF phase. The application of the AC offset to the trap and/or a lens 4 outside the entrance endcap 13 can distort the RF field which is penetrating out of the entrance endcap aperture 16. The AC offset applied to the trap and/or a lens 4 can compensate for or adjust this RF fringe field so that ions can penetrate the fringe field and enter the ion trap. At the same time, the AC offset voltage is used to manipulate, to our advantage, the kinetic energy and RF phase at which ions enter the ion trap. In a specific embodiment, it is advantageous to use non-sinusoidal AC offsets to more closely tailor the kinetic energy and RF phase at which ions enter the ion trap to maximize the improvement in the trapping efficiency.

It should be understood that the examples and embodiments described herein are for illustrative purposes only and that various modifications or changes in light thereof will be suggested to persons skilled in the art and are to be included within the spirit and purview of this application and the scope of the appended claims.

References

Paul, W. and H. Steinwedel (1960) U.S. Pat. No. 2,939,952.

March, R. E. and R. J. Hughes, Eds. (1989) *Quadrupole Storage Mass Spectrometry*

March, R. E., J. F. J. Todd, Eds. (1995) *Practical Aspects of Ion Mass Spectrometry* v. I–III.

Moore, R. B.; S. Gulick (1988) *Physica Scripta* T22:28–35.

Louris, J. N.; J. Amy.; T. Ridley; R. G. Cooks (1989) *International Journal of Mass Spectrometry and Ion Processes* 88:97–111.

Moore, R. B., G. Rouleaui; the ISOLDE Collaboration (1992) *Journal of Modern Optics* 39:361–371.

Moore, R. B., M. D. N. Lunney, G. Rouleau, G. Savard (1992) *Nuclear Instruments and Methods in Physics Research* B70:482–489.

Moore, R. B.; M. D. N. Lunney, G. Rouleau, G. Savard (1992) *Physica Scripta* 46:569–574.

Moore, R. B. (1993) *Hyperfine Interactions* 81:45–70.

Doroshenko, V. M.; R. J. Cotter (1993) *Rapid Communications in Mass Spectrometry* 7:822–827.

Eiden, G. C. et al. (1994) *International Journal of Mass Spectrometry and Ion Processes* 136:119–141.

Wang, Y., M. Schubert and J. Franzen (1995) *Proceedings of the 43rd ASMS Conference on Mass Spectrometry and Allied Topics*, pg 1106.

Qin, J. and B. T. Chait (1996) *Analytical Chemistry* 68:2102–2107.

Ghosh, P. K. et al. (1977) *International Journal of Mass Spectrometry and Ion Processes* 23:237–240.

O, C. S. and H. A. Schuessler (1981) *Journal of Applied Physics* 52:1157–1166.

Weil, C. et al. (1996) *Rapid Communications in Mass Spectrometry* 10:742–750.

We claim:

1. A quadrupole ion trap mass spectrometer having a ring electrode and endcap electrodes defining a trap volume into which sample ions are injected, wherein said ion trap mass spectrometer comprises:

means for applying voltages to said electrodes to generate a three-dimensional trapping field within said ion trap; and means for applying a periodic time varying voltage;

wherein the application of said periodic time varying voltage increases the trapping efficiency of the injected ions by altering the kinetic energy or arrival time of the injected ions.

2. The quadrupole ion trap mass spectrometer, according to claim 1, wherein the voltages applied to generate a three-dimensional trapping field include a fundamental RF trapping voltage applied to the ring electrode, wherein said periodic time varying voltage has a frequency equal to the frequency, a multiple of the frequency, or a submultiple of the frequency, of the fundamental RF trapping voltage applied to the ring electrode.

3. The quadrupole ion trap mass spectrometer, according to claim 2, wherein said periodic time varying voltage is an AC offset sinusoidal voltage.

4. The quadrupole ion trap mass spectrometer, according to claim 2, wherein said periodic time varying voltage is phase offset from said fundamental RF trapping voltage.

5. The quadrupole ion trap mass spectrometer, according to claim 1, wherein said periodic time varying voltage is applied to the ring electrode and the endcap electrodes.

6. The quadrupole ion trap mass spectrometer, according to claim 5, further comprising:

shielding means located outside the ion trap, wherein said shielding means shields the incoming ions from the voltages applied to the ring electrode and endcap electrodes while the ions are outside the shielding means, wherein after passing said shielding means the ions are affected by the voltages applied to the ring electrode and endcap electrodes.

7. The quadrupole ion trap mass spectrometer, according to claim 6, wherein said shielding means is a lens.

8. The quadrupole ion trap mass spectrometer, according to claim 1, further comprising:

a lens located outside the ion trap, wherein said periodic time varying voltage is applied to said lens.

9. The quadrupole ion trap mass spectrometer, according to claim 8, further comprising:

at least one additional lens located outside the ion trap, wherein at least one additional periodic time varying voltage is applied to said at least one additional lens.

10. The quadrupole ion trap mass spectrometer, according to claim 9, further comprising:

a shielding means located outside said at least one additional lens, wherein after passing said shielding means the ions are affected by the at least one additional periodic time varying voltage applied to said at least one additional lens.

11. The quadrupole ion trap mass spectrometer, according to claim 8, further comprising:

a shielding means located outside said lens, wherein after passing said shielding means the ions are affected by the periodic time varying voltage applied to said lens.

12. The quadrupole ion trap mass spectrometer, according to claim 8, wherein an additional periodic time varying voltage is applied to the ring electrode and the endcap electrodes, wherein the application of said additional periodic time varying voltage increases the trapping efficiency of the injected ions by altering the ions' kinetic energies or arrival times.

13. A method of quadrupole ion trap mass spectrometry utilizing a quadrupole ion mass spectrometer having a ring electrode and endcap electrodes defining a trap volume into which sample ions are injected, comprising the steps of:

applying voltages to said electrodes to provide a trapping field to trap ions having masses of interest; and applying a periodic time varying voltage;

wherein the application of said periodic time varying voltage increases the trapping efficiency of the injected ions by altering the ions' kinetic energies or arrival times.

14. The method of quadrupole ion trap mass spectrometry, according to claim 13, wherein said voltages applied to said electrodes to provide a trapping field to trap ions having masses of interest include a fundamental RF trapping voltage applied to the ring electrode, wherein said periodic time varying voltage has a frequency equal to the frequency, a multiple of the frequency, or a submultiple of the frequency, of the fundamental RF trapping voltage applied to the ring electrode.

15. The method of quadrupole ion trap mass spectrometry, according to claim 14, wherein said periodic time varying voltage is an AC offset sinusoidal voltage.

16. The method of quadrupole ion trap mass spectrometry, according to claim 14, wherein said periodic time varying voltage is phase offset from said fundamental RF trapping voltage.

17. The method of quadrupole ion trap mass spectrometry, according to claim 13, wherein said periodic time varying voltage is applied to the ring electrode and endcap electrodes.

18. The method of quadrupole ion trap mass spectrometry, according to claim 17, further comprising the step of:

shielding the incoming ions from the voltages applied to the ring electrode and endcap electrodes until the ions are within a predetermined distance from the ion trap, wherein once the ions are within said predetermined distance the ions are affected by the voltages applied to the ring electrode and endcap electrodes.

19. The method of quadrupole ion trap mass spectrometry, according to claim 18, wherein said ions are shielded from said voltages by a lens.

20. The method of quadrupole ion trap mass spectrometry, according to claim 13, wherein said periodic time varying voltage is applied to a lens located outside of the ion trap.

21. A method of quadrupole ion trap mass spectrometry, according to claim 20, further comprising the step of:

applying at least one additional periodic time varying voltage to each of at least one additional lens located outside the ion trap, wherein the application of said at least one additional periodic time varying voltage increases the trapping efficiency of the injected sample ions by altering the injected ions' kinetic energies or arrival times.

22. The method of quadrupole ion trap mass spectrometry, according to claim 21, further comprising the step of:

shielding the incoming ions from said periodic time varying voltages applied to said lenses until the ions are within a predetermined distance from said lenses, wherein once the ions are within said predetermined distance the ions are affected by the voltages applied to said lenses.

23. The method of quadrupole ion trap mass spectrometry, according to claim 20, further comprising the step of:

shielding the incoming ions from the voltages applied to the lens until the ions are within a predetermined distance from the lens, wherein once the ions are within said predetermined distance the ions are affected by the voltages applied to the ring electrode and endcap electrodes.

24. The method of quadrupole ion trap mass spectrometry, according to claim 20, further comprising the step of:

applying an additional periodic time varying voltage to the ring electrode and endcap electrodes, wherein the application of said additional periodic time varying voltage increases the trapping efficiency of the injected ions by altering the ions' kinetic energies or arrival times.

* * * * *

UNITED STATES PATENT AND TRADEMARK OFFICE

CERTIFICATE OF CORRECTION

PATENT NO. : 5,747,801

DATED : May 5, 1998

INVENTOR(S) : Scott T. Quarmby and Richard A. Yost

It is certified that error appears in the above-identified patent and that said Letters Patent is hereby corrected as shown below:

Column 2, line 12: "(for example, 0 et al." should read --(for example, O *et al.*--.

Column 9, line 47: "approximately 105° - 20°" should read--approximately 105° - 200°--.

Column 11, line 22: "*Ion Mass Spectrometry*" should read --*Ion Trap Mass Spectrometry*--.

Signed and Sealed this

Eighteenth Day of August, 1998

Bruce Lehman

*Attest:*

BRUCE LEHMAN

*Attesting Officer*

*Commissioner of Patents and Trademarks*